US009920761B2

(12) United States Patent
Schofield et al.

(10) Patent No.: US 9,920,761 B2
(45) Date of Patent: Mar. 20, 2018

(54) VACUUM PUMP ROTOR FOR A VACUUM PUMP HAVING A ROOTS PUMPING MECHANISM

(71) Applicant: Edwards Limited, Crawley, West Sussex (GB)

(72) Inventors: Nigel Paul Schofield, Horsham (GB); Stephen Dowdeswell, Cuckfield (GB)

(73) Assignee: Edwards Limited, Crawley (GB)

( * ) Notice: Subject to any disclaimer, the term of this patent is extended or adjusted under 35 U.S.C. 154(b) by 56 days.

(21) Appl. No.: 14/968,849

(22) Filed: Dec. 14, 2015

(65) Prior Publication Data

US 2016/0097390 A1 Apr. 7, 2016

Related U.S. Application Data

(63) Continuation of application No. 14/114,896, filed as application No. PCT/GB2012/050889 on Apr. 23, 2012, now abandoned.

(30) Foreign Application Priority Data

May 4, 2011 (GB) ..... 1107382.2

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 18/12*** | (2006.01) |
| ***F01C 1/12*** | (2006.01) |
| ***F04C 2/12*** | (2006.01) |

(Continued)

(52) U.S. Cl.

CPC ..... *F04C 18/126* (2013.01); *F01C 1/084* (2013.01); *F01C 1/126* (2013.01); *F01C 21/08* (2013.01); *F04C 2/084* (2013.01); *F04C 2/126* (2013.01); *F04C 25/02* (2013.01); *F04C 18/084* (2013.01); *F04C 29/0078* (2013.01);

(Continued)

(58) Field of Classification Search

CPC ..... F04C 2/126; F04C 2/084; F04C 18/126; F04C 18/084; F04C 2240/20; F04C 2230/00; F01C 1/126; F01C 1/084

USPC ..... 418/206.1–206.9, 199, 190, 9, 1; 29/888.02, 888.023

See application file for complete search history.

(56) References Cited

U.S. PATENT DOCUMENTS

| | | | |
|---|---|---|---|
| 1,030,083 | A | 6/1912 | Green |
| 2,944,732 | A | 7/1960 | Lorenz |

(Continued)

FOREIGN PATENT DOCUMENTS

| | | |
|---|---|---|
| DE | 415864 | 7/1925 |
| DE | 693372 C | 7/1940 |

(Continued)

OTHER PUBLICATIONS

Notification of Transmittal of the International Search Report and the Written Opinion of the International Searching Authority dated Aug. 7, 2013 in corresponding PCT Application No. PCT/GB2012/050889, 14 pgs.

(Continued)

*Primary Examiner* — Theresa Trieu

(74) *Attorney, Agent, or Firm* — Shumaker & Sieffert, P.A.

(57) ABSTRACT

The present invention relates to a rotor for a vacuum pump 150 having a roots pumping mechanism, the rotor comprising at least two hollow lobes 160, 162, 164, 166, each lobe having an outer wall 208 which defines a lobe profile, a hollow cavity 210 generally inward of the outer wall, and at least one strengthening rib 226 located in the cavity to resist stress on the lobes generated during rotation.

16 Claims, 7 Drawing Sheets

(51) Int. Cl.

| | |
|---|---|
| ***F01C 1/08*** | (2006.01) |
| ***F01C 21/08*** | (2006.01) |
| ***F04C 25/02*** | (2006.01) |
| ***F04C 2/08*** | (2006.01) |
| *F04C 29/00* | (2006.01) |
| *F04C 18/08* | (2006.01) |

(52) U.S. Cl.
CPC ..... *F04C 2230/00* (2013.01); *F04C 2240/20* (2013.01); *Y10T 29/49236* (2015.01)

(56) References Cited

U.S. PATENT DOCUMENTS

| | | | |
|---|---|---|---|
| 5,180,299 | A | 1/1993 | Feuling |
| 6,699,023 | B2 | 3/2004 | Naito et al. |
| 2014/0079581 | A1 | 3/2014 | Schofield |

FOREIGN PATENT DOCUMENTS

| | | | |
|---|---|---|---|
| DE | 10056168 | A | 5/2002 |
| EP | 2194275 | A | 6/2010 |
| GB | 191209613 | A | 8/1912 |
| GB | 325425 | A | 2/1930 |
| GB | 414813 | A | 8/1934 |
| JP | 01249975 | A | 10/1989 |

OTHER PUBLICATIONS

Search Report under Section 17(5) dated Aug. 22, 2011 in corresponding GB Application No. GB1107382.2, 4 pgs.
Search and Examination Report from counterpart United Kingdom Application No. 1714878.4, dated Sep. 27, 2017, 5 pp.
Search and Examination Report from counterpart British Application No. 1714878.4, filed on Sep. 27, 2017, 5 pp.

VACUUM PUMP ROTOR FOR A VACUUM PUMP HAVING A ROOTS PUMPING MECHANISM

PRIORITY CLAIM

This application is a continuation of U.S. application Ser. No. 14/114,896 filed Oct. 30, 2013, which is a national stage entry under 35 U.S.C. § 371 of PCT Application No. PCT/GB2012/050889, filed Apr. 23, 2012, which claims the benefit of British Application No. 1107382.2, filed May 4, 2011. The entire contents of U.S. application Ser. No. 14/114,896, PCT Application No. PCT/GB2012/050889 and British Patent Application No. 1107382.2 are incorporated herein by reference.

TECHNICAL FIELD

The invention relates to a rotary positive displacement pump and a rotor of such a pump. In particular the invention relates to Roots pumps (also known as Roots blowers).

BACKGROUND

Roots pumps typically comprise a pair of meshed, lobed rotors which rotate within a housing, causing fluid to become trapped in pockets surrounding the lobes and to be transferred from the pump inlet to the pump outlet. The rotors do not actually touch each other or the housing, so no lubricant is needed. This makes Roots pumps desirable in applications where contamination of the fluid is a problem, for example in semiconductor processing.

A simplified diagram of a typical Roots pump 100 is shown in FIG. 1. A pumping chamber 101 is formed by a plurality of stator components, including a stator housing 102 and two transverse end walls 104. The end walls 104 have apertures 106 through which two rotor shafts 108, 110 extend. The shafts are supported at each end by bearings 112. A motor 114 drives rotation of one shaft 108 and a gear mechanism 116 transmits the rotational power to the other shaft 110. The gear mechanism causes the shafts to rotate in synchronisation in opposite directions.

The shafts have mounted thereto respective pairs of rotor lobes 118, 120 and 122, 124. The radial tip of lobe 122 is hidden by lobe 120 and therefore is designated by broken lines. FIG. 2 shows a section through pump taken along the line II-II, in which the rotor lobes can be seen more clearly. As the rotors rotate, the lobes sweep past the internal surface 126 of the pumping chamber 101 thereby pumping fluid from a chamber inlet 128 to a chamber outlet 130. The tolerances between the rotor lobes and the swept surface 126 must be tightly controlled, as must the tolerances between the rotors, otherwise gaps will be generated through which fluid can pass, thereby decreasing the efficiency of the pump. Typical tolerances are in the region of 0.1 mm.

Typical Roots pumps have a reasonably high pumping capacity, but for some applications it is desirable to further increase the capacity of the pump. This can be achieved, whilst maintaining lobe tip speed, by providing a larger pump with bigger lobes. However, this is disadvantageous in that the pumps become more expensive, and if there is an accident, for example if the rotors clash, the increased energy of the lobes can be sufficient for the lobes to break through the pump housing and cause damage or injury.

Alternatively, the capacity of the pump can be increased by causing the rotors to spin faster. A typical lobe tip speed during rotation is less than 100 m/s and often less than 80 m/s. A significant increase in velocity at the tip of the lobes to for example 130 m/s would allow the lobes to be made smaller, and reduce the cost of the pump. However, even though the lobes are less massive, the increased rotational speed causes an increase in lobe energy, and in the event of an accident can likewise cause damage or injury. It should also be noted that increasing the speed causes a larger increase in kinetic energy than increasing the mass, since the energy is proportional to the mass but it is proportional to the square of the speed.

Conventional rotors are usually made from a solid block of material, typically cast iron. Such rotors may be made in various ways, including casting solid lobes and a shaft integrally, or casting solid lobes and attaching the lobes to a shaft to form the rotor.

Known lobes may be manufactured by casting a solid lobe and then drilling a hole in it to reduce its weight.

SUMMARY

The present invention aims to increase the pumping capacity of such rotary positive displacement pumps by further reducing the weight of the rotors for a given size of pump. The present invention also aims to alleviate known problems of using hollow lobes, in particular the problems of ensuring that the lobe walls remain strong enough to withstand operational stresses and do not deform out of tolerance.

According to the present invention there is provided a vacuum pump rotor for use in a vacuum pump having a roots pumping mechanism, the rotor comprising at least two hollow lobes, each lobe having an outer wall which defines a lobe profile, a hollow cavity generally inward of the outer wall, and at least one strengthening rib located in the cavity to resist stress on the lobes generated during rotation.

The or each strengthening rib may extend around an interior wall of the lobes. The or each strengthening rib may have a varying extent and be distributed within the cavity dependent on the varying stresses applied to the lobes in use.

The outer wall may have a varying thickness and is thicker at a radially inner portion than at a lobe tip.

The outer wall of the lobes may have a thickness such that the lobes deform under centrifugal loading when the rotor is rotated in use and the deformation is greater than manufacturing tolerances.

The lobe profiles may have an optimal configuration in a first condition in which the rotor is rotated in use and a second condition when the rotor is not rotated and the lobe profile is not in an optimal configuration, and wherein the lobe deforms from the second condition to the first condition when tip speed of the lobes is greater than 100 m/s.

Preferably, a ratio of the thickness of the wall to a radius at the lobe tip is less than 1:20. The thickness of the wall may be less than 5 mm when the radius of the lobe tip is at least 100 mm.

Each hollow lobe may comprise a plurality of hollow lobe sections joined in axial succession along the rotor which together form said lobe.

Each of the hollow lobe sections may have a flange extending circumferentially and radially inwardly around at least one axial end of the section for joining together adjacent sections.

One or more holes may be provided in the flanges for allowing the hollow lobe sections to be fastened together by fixing members.

Each lobe may further comprise two end faces for closing the cavity at each axial end of the lobe.

The rotor may comprise a shaft and the lobes may comprise means by which the lobe can be fixed to the shaft, the lobes and the shaft being shaped to provide a generally continuous profile of the at least two lobes and the shaft.

The hollow lobe and the shaft of the rotor may be adapted to fit together by means of a dovetail or similar joint, such that the radial movement of the hollow lobe section with respect to the shaft of the rotor is minimised.

The rotor may comprise venting means to allow the pressure within the hollow cavity to substantially equalise with the pressure outside of the hollow lobes. The venting means may comprise a filter for filtering deposits from gas conveyed through the venting means into the cavity.

The invention also provides a vacuum pump comprising a rotor as set forth above.

The pump may comprise a plurality of pumping stages, each of which comprise a pumping chambers and at least two said lobes.

At least one of the pumping stages may comprise a lobe having a plurality of lobe sections joined together in axial succession.

The strengthening ribs in the lobe cavities may extend in respective radial planes relative to the axes of the rotor shafts, and the radial planes of the lobes of one rotor are misaligned with the radial planes of the other rotor.

The portions of the lobes between radial planes may be arranged to deform when impacted by the portions of the lobes in line the radial planes to absorb energy of the rotors in the event of an accidental rotor clash.

The present invention also provides a method of making a rotor for a vacuum pump, the method comprising providing the rotor with at least two hollow lobes, each lobe having an outer wall which defines a lobe profile and a hollow cavity generally inward of the outer wall, and locating within the hollow cavity at least one strengthening rib to resist stress on the lobes generated during rotation.

BRIEF DESCRIPTION OF THE DRAWINGS

The present invention will now be described with reference to the accompanying drawings, of which.

DETAILED DESCRIPTION

Figure 1:
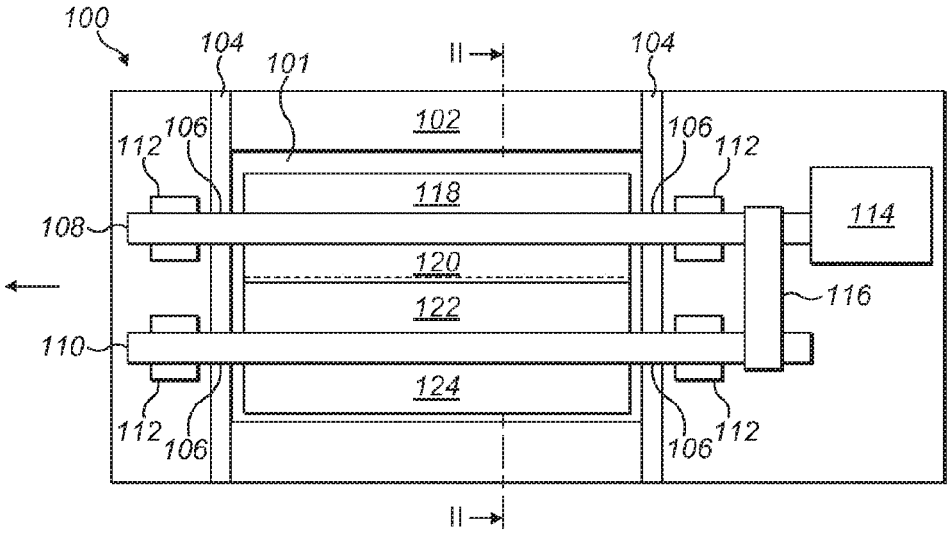
FIG. 1 (PRIOR ART)
FIG. 1 shows a schematic diagram of a known Roots pump.
Figure 2:
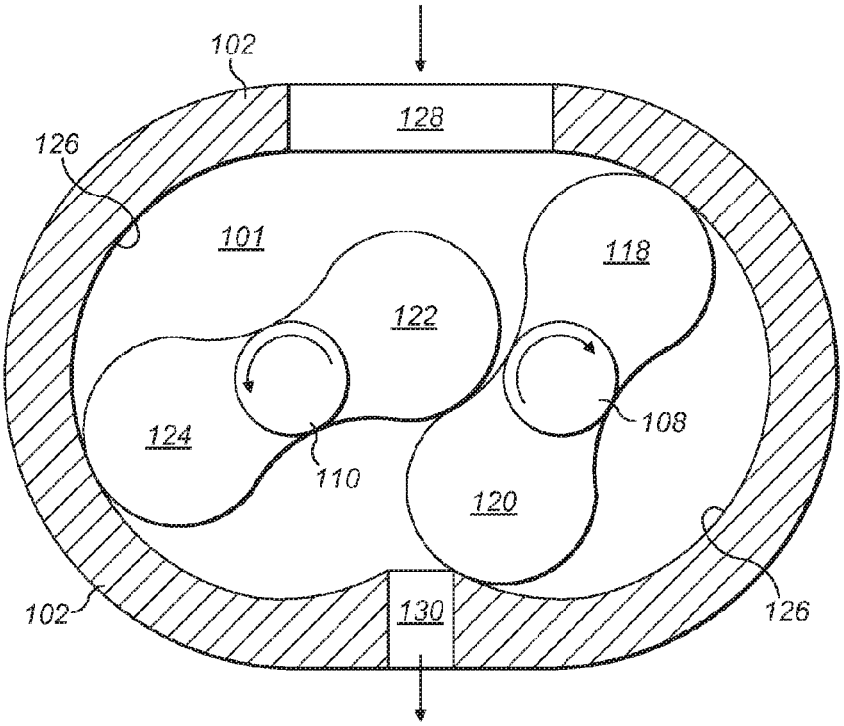
FIG. 2 (PRIOR ART)
FIG. 2 shows a cross-section through the known Roots pump of FIG. 1.

FIGS. 1 and 2 show a typical Roots pump. These figures are described above in the introductory part of this document, as they form part of the state of the art.

Figure 3:
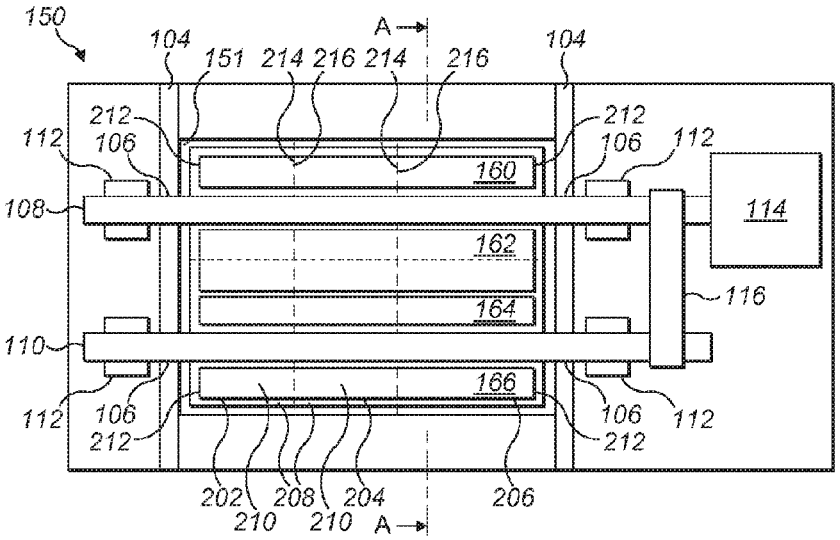
FIG. 3 shows a schematic diagram of a Roots pump in accordance with the present invention.

FIG. 3 shows a pump according to the present invention. Some features are common to both the invention and the prior art pump, and these features are denoted by common reference numerals. A pump 150 has a pumping chamber 151 which is formed by a plurality of stator components, including a stator housing 102 and two transverse end walls 104. The end walls 104 have apertures 106 through which two rotor shafts 108, 110 extend. The shafts are supported at each end by bearings 112. A motor 114 drives rotation of one shaft 108 and a gear mechanism 116 transmits the rotational power to the other shaft 110. The gear mechanism causes the shafts to rotate in synchronisation in opposite directions.

The shafts have mounted thereto respective pairs of rotor lobes 160, 162 and 164, 166. In this schematic representation, the rotors are shown in a configuration to aid in the description of the embodiment of the invention to show thin walls 208 and cavities 210. All of the rotor lobes are hollow, each lobe having a thin, curved outer wall 208 which surrounds a cavity 210. Furthermore, all of the rotor lobes are of axially modular construction. The thin wall 208 has a thickness in a ratio of less than 1:20 with the tip radius of the lobe. Preferably, the ratio is less than 1:40 and more preferably around 1:100. For a pump having a lobe tip radius of 200 mm, the thickness is preferably less than 10 mm, more preferably less than 5 mm and ideally approximately 2 mm-4 mm thick. In this example, each lobe is formed from three hollow lobe sections, although two, four or more hollow lobe sections may be used instead depending on the desired axial length of the rotor. Lobe 166 is formed from hollow lobe sections 202, 204 and 206, and two end plates 212, one end plate being located at each axial end of the lobe. The hollow lobe sections may be of identical axial length or may be of different axial lengths. For manufacturing ease, it is usually desirable to use hollow lobe sections of the same axial length. In this example, the hollow lobes are machined from alloy steel for high strength and good temperature resistance. Other materials, such as aluminium, could be used instead. Also, the hollow lobe sections may be manufactured by other known manufacturing techniques. The hollow lobe sections have a flange 214, 216 at either axial end, to allow the hollow lobe sections to be fitted together. This is described in more detail with respect to FIG. 5. Alternatively the flange 214, 216 may be fixed to an end plate 212 if the hollow lobe section is to be located at an axial end of the rotor.

Figure 4:
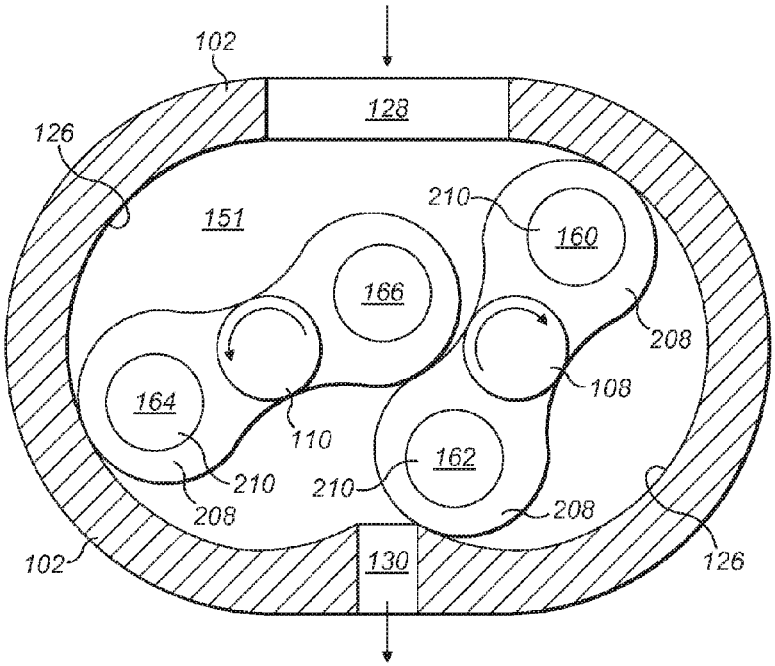
FIG. 4 shows a cross-section through the Roots pump of FIG. 3.

FIG. 4 shows a section through the pump of FIG. 3 taken along the line A-A, in which the hollow rotor lobes can be seen more clearly. The rotors shown in FIG. 4 are not in the same configuration as shown in FIG. 3 as will be appreciated by those familiar with roots pumps. As the rotors rotate, the hollow lobes 160, 162, 164, 166 sweep past the internal surface 126 of the pumping chamber 151 thereby pumping fluid from a chamber inlet 128 to a chamber outlet 130.

Figure 5:
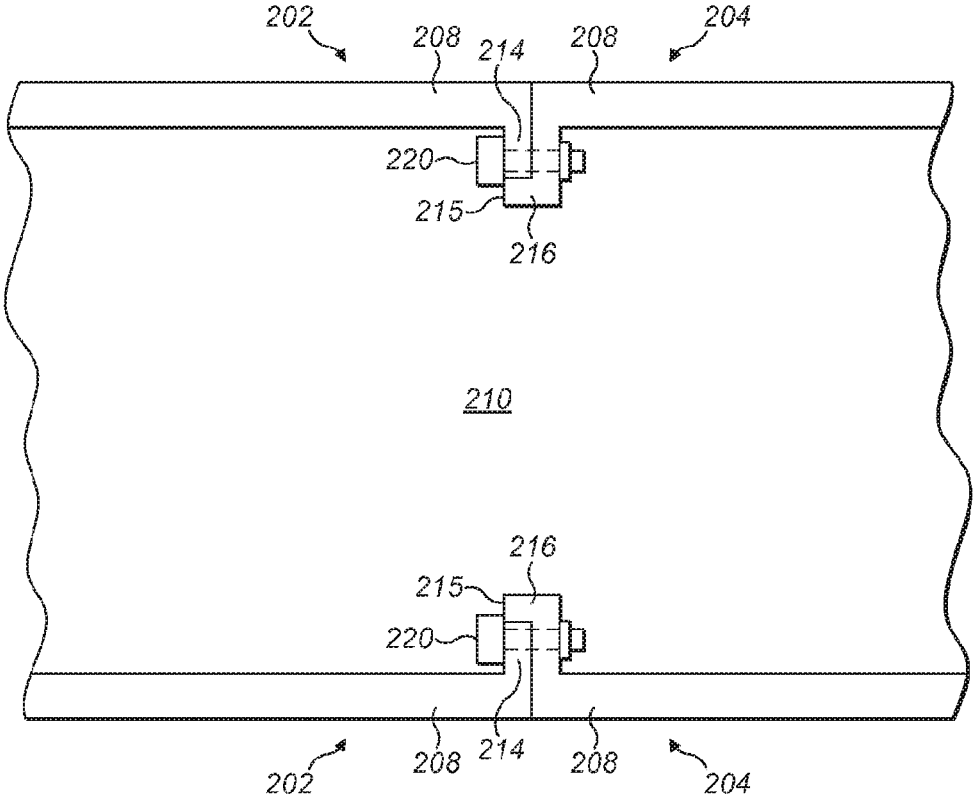
FIG. 5 shows a cutaway diagram of a hollow lobe which forms part of the Roots pump shown in FIGS. 3 and 4.

FIG. 5 shows the joint between the hollow lobe sections 202 and 204 in more detail. Hollow lobe section 202 has a flange 214 which extends circumferentially and radially inwardly around the axial end of the hollow lobe section 202. Similarly, hollow lobe section 204 has a flange 216 which extends circumferentially and radially inwardly around the axial end of the hollow lobe section 204. Flange 216 has a lip 215 which permits the flange 216 to overlap the flange 214. A hole (shown in FIG. 6) is provided in each of the flanges to allow the hollow lobe sections 202, 204 to be fastened together using a bolt 220. It is important that the holes are correctly aligned so that the outer walls of the hollow lobe sections remain flush when bolted together, and so that the joint seals, as far as possible, the inner cavity 10 from the pumping chamber 151. To ensure that a fluid-tight seal is achieved, sealant may additionally be provided to the joint. The lip 215 is optional, but it helps in achieving a well-sealed joint. Where there are manufacturing or other constraints, the lip may be omitted. In this case flange 216 will have the same form as flange 214, and the flanges can be bolted together as described above.

Figure 6:
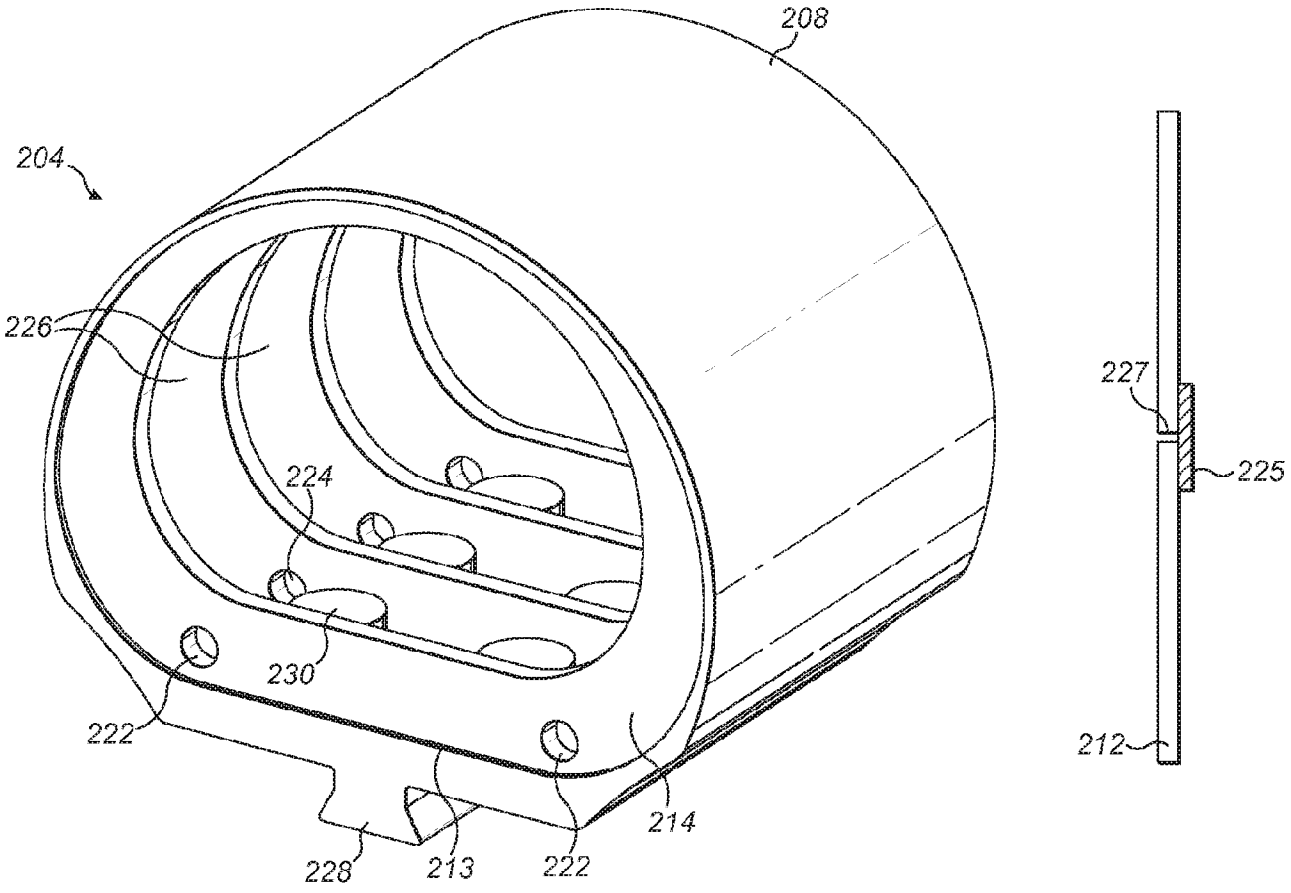
FIG. 6 shows an isometric view of a hollow lobe section in accordance with the present invention and an end plate.

FIG. 6 shows a hollow lobe section 204 in more detail. A thin outer wall 208 defines a cavity 210, which is open at both axial ends. Strengthening ribs 226 are provided to give the thin outer wall increased strength to withstand stresses when the pump is in use, and to maintain the desired profile of the lobes in use. The ribs extend around the inner peripheral surface of the curved wall 208 and are distributed according to the stress encountered during rotation. It will be seen in this regard that the amount by which the ribs project from the inner surface of the lobe varies over the peripheral extent of the lobe. The radially inner portion of the ribs project the most where working stresses are highest and as the stresses reduce the ribs project to a lesser extent. The ribs are provided with holes 224 for balancing the rotor, for example by adding nuts and bolts thereto. Alternatively the holes may be drilled at appropriate locations of the ribs to remove mass and thereby balance the lobes. At each axial end of the hollow lobe section a flange 214 extends circumferentially around the inner surface of the curved wall. Flange 214 may, for manufacturing ease, be identical to the strengthening ribs 226. Holes 222 are provided to allow flange 214 to be bolted to the flange of an adjacent hollow lobe section as shown in FIG. 5. Alternatively, the flange 214 may be bolted to an end plate 212 if the hollow lobe section is to be located at an axial end of the rotor. An end plate 212 is shown in FIG. 6 and is shaped to fit into the recess defined by wall 213 in flange 214. The end plate 212 has a through bore 227 to allow the cavity of the lobe to vent and the pressure in the cavity to equalise with the pressure in the pumping chamber. If gas pressure in the cavity is greater than in the pumping chamber, due to imperfect sealing the gas will seep out of the cavity and reduce pumping efficiency. A filter media 225 such as a fibre glass mat prevents solid deposits generated from a pumped process gas from entering and accumulating in the cavity. Accumulated deposits would increase lobe mass and cause the lobe to become unbalanced.

High strength bolts 230 and corresponding holes 234 are provided to allow the hollow lobe section to be bolted to the rotor shaft. A dovetail 228 is also provided for fitting into a complementary shaped groove in the rotor shaft to form a dovetail joint. The dovetail joint is useful as it aids alignment of the hollow lobe sections during assembly of the lobe. Furthermore it also provides a safety back up system in that if the bolts fixing the hollow lobe section to the rotor shaft fail (eg they shear due to fatigue or due to a rotor crash) the dovetail joint acts to prevent the lobes breaking free of the rotor shaft and causing serious damage.

Figure 7:
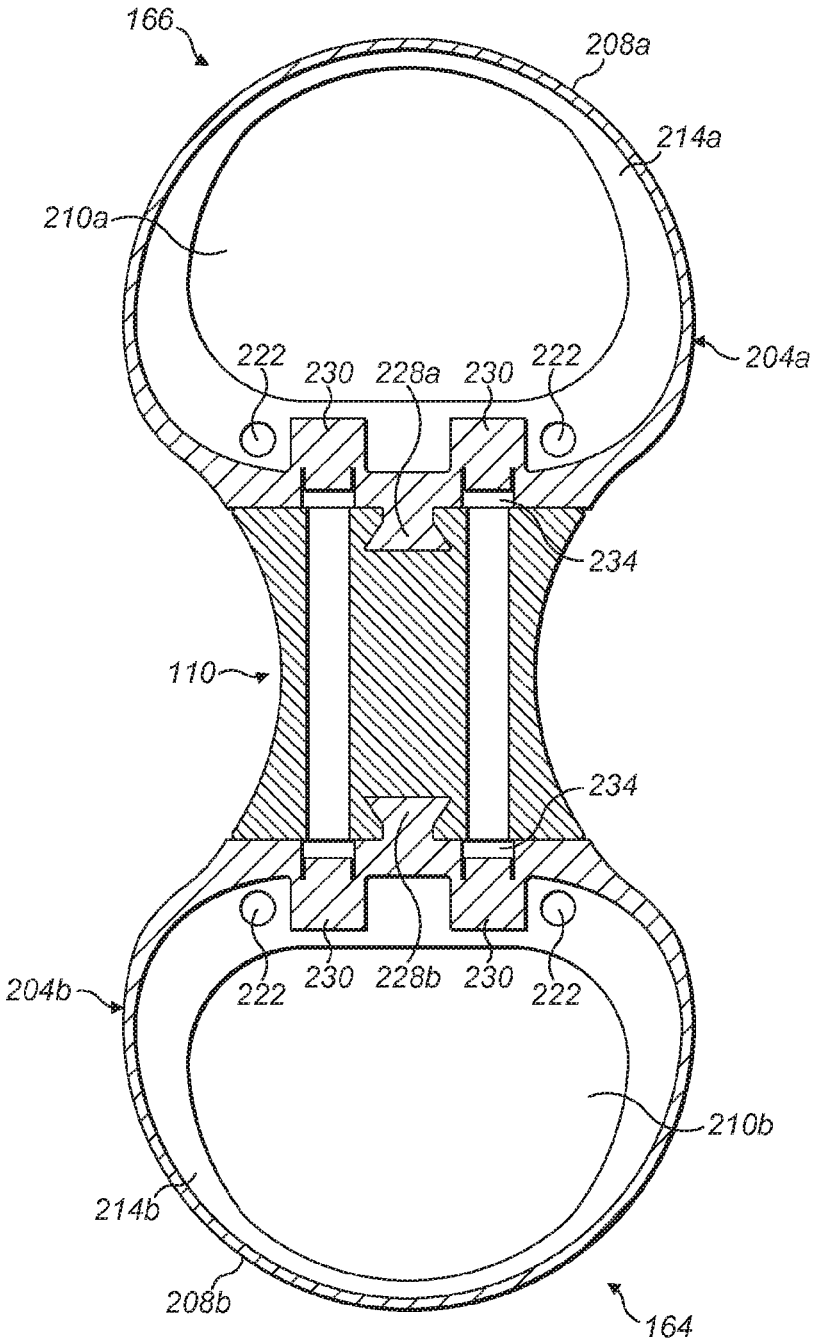
FIG. 7 shows a cross-sectional view through a rotor having hollow lobe sections as depicted in FIG. 6.

FIG. 7 shows a pump rotor having two hollow lobes 164 and 166 and a rotor shaft 110. The hollow lobes are formed from hollow lobe sections 204*a*, 204*b* and each have thin curved walls 208*a*, 208*b* which enclose a cavity 210*a*, 210*b*. A flange 214*a*, 214*b* is provided for allowing the hollow lobe section to be attached to either another hollow lobe section or to an end plate, as desired. Holes 222 are provided in the flanges 214*a*, 214*b* to facilitate attachment. High strength bolts 230 are used to attach the hollow lobe sections to the rotor shaft 110. The hollow lobe sections each have a dovetail 228*a*, 228*b* which fits into a complementary shaped groove in the rotor shaft to form a dovetail joint.

The configuration of the lobes having a thin wall and hollow cavity reduces the mass of the lobes, whilst maintaining the exterior lobe profile. Since the mass is reduced the rotors can be spun more quickly without increasing the amount of energy stored in the rotating lobes. For example, the rotors may be spun at a lobe tip speed of more than 100 m/s and preferably at around 130 m/s. In known designs, spinning the rotors at such speeds would increase the stored energy in the rotors above acceptable limits with the risk of damage or injury in the event of an accident. It should also be noted that spinning a thin walled hollow lobe at speeds of around 130 m/s requires the use of the previously discussed strengthening ribs which are necessary for absorbing the increased stresses on the lobes. Even with the strengthening ribs, the lobes deform at high rotational speeds due to centrifugal loading. The deformation caused is greater than manufacturing tolerances. In this regard, deformation at the lobe tip may be 0.5 to 1 mm whereas manufacturing tolerances may be 0.1 to 0.2 mm. Therefore embodiments of the present invention are designed so that the lobes adopt an optimal pumping condition when rotated at high speeds. That is the lobes deform under centrifugal loading at high speeds to adopt an optimal configuration. Known pumps deform under loading but by less than manufacturing tolerances for example by 0.1 to 0.2 mm.

It necessarily follows that at low speeds the hollow lobes are not in an optimal pumping condition and therefore gaps will be present between the lobe profiles and between the lobe profiles and the swept surface of the pumping chamber. These gaps will cause leakage and reduce pumping efficiency however the reduced efficiency at low rotational speeds is an acceptable drawback for increased pumping at high speeds.

Figure 8:
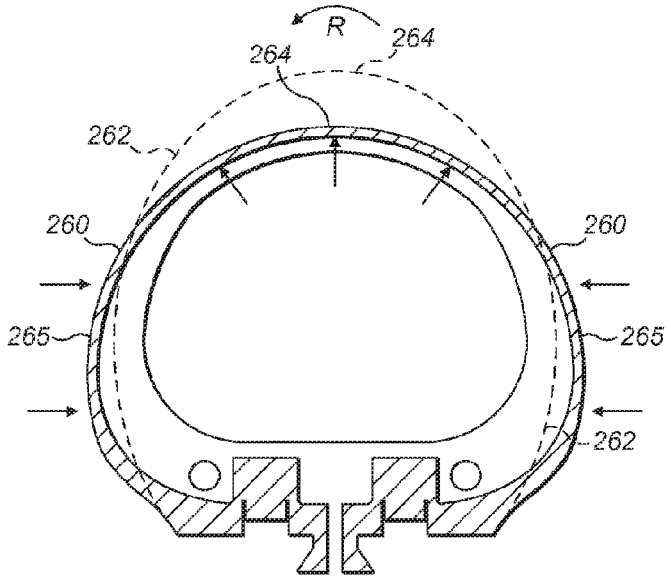
FIG. 8 shows deformed and non-deformed conditions of a rotor lobe.

FIG. 8 shows in solid lines an undeformed condition of a hollow lobe when the pump is at rest and in broken lines the exterior profile of the lobe when in a deformed condition and the pump is rotated at high speeds. The deformation shown in FIG. 8 is greatly exaggerated for the purposes of explanation.

In more detail, the lobe deforms radially outwardly at the lobe tip 264 as the lobe is stretched under centrifugal force. The lobe sides 265 deform inwardly towards a centre of the lobe. The wall thickness of the lobe varies and is thicker at the sides than at the lobe tip, helping to avoid the greater stresses on the lobe towards a centre of rotation which decrease radially outwardly. Likewise, the strengthening ribs protrude to a greater extent into the cavity at the lobe base and side than at the lobe tip.

This lobe configuration permits much thinner lobe walls (and therefore lobes of lighter mass) to be used than if a non-deforming design was utilised. Furthermore, the rotor shaft 110 is designed to complement the external profile of the hollow lobe sections when the pump is operational, to create an optimum profile for the rotor, as shown in FIG. 7.

Figure 9:
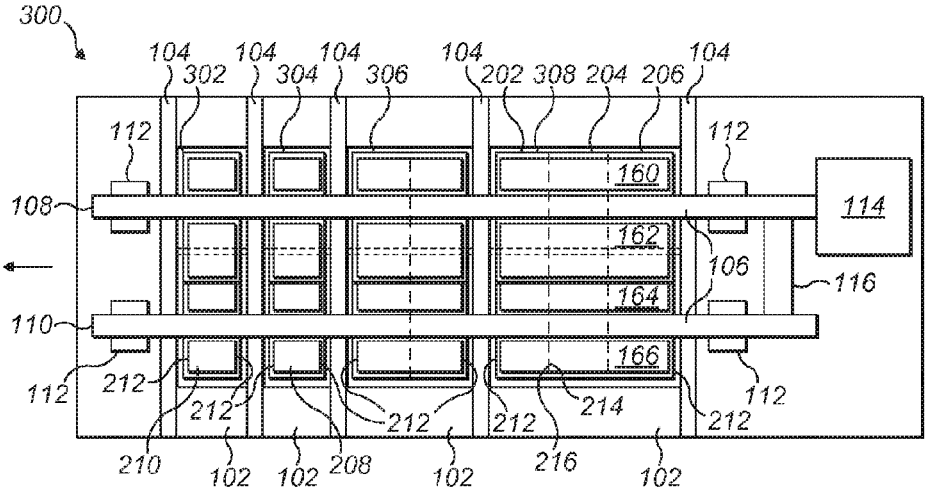
FIG. 9 shows a schematic diagram of a multi-stage pump in accordance with the present invention.

FIG. 9 shows a multi-stage pump 300 having four pumping chambers 308, 306, 304 and 302. The first pumping chamber 308 has three hollow lobe sections joined together to form each lobe, the second pumping chamber 306 has two hollow lobe sections joined together to form each lobe and the third and fourth pumping chambers 304, 302 have only one hollow lobe section per lobe each. Within each of the pumping chambers, each of the lobes have an end plate 212 at either axial end so that the cavity 210 within each lobe is fully enclosed. Each of the pumping chambers is formed by a plurality of stator components, including a stator housing 102, and two transverse end walls 104. The end walls 104 have apertures 106 through which two rotor shafts 108, 110 extend. The shafts are supported at each end by bearings 112. A motor 114 drives rotation of one shaft 108 and a gear mechanism 116 transmits the rotational power to the other shaft 110. The gear mechanism causes the shafts to rotate in synchronisation in opposite directions.

The pumping chamber 308 is similar to the pumping chamber 151 depicted in FIG. 3 and is shown schematically to describe the invention. Within the pumping chamber 308, the rotor shafts 108, 110 have mounted thereto respective pairs of rotor lobes 160, 162 and 164, 166. All of the rotor lobes are hollow, each lobe having a thin, curved outer wall 208 which surrounds a cavity 210. Furthermore, all of the rotor lobes are of axially modular construction. The thin wall 208 is approximately 2 mm-4 mm thick. In this example, each lobe is formed from three hollow lobe sections, although two, four or more hollow lobe sections may be used instead depending on the desired axial length of the rotor. The hollow lobe sections have a flange 214, 216 at either axial end, to allow the hollow lobe sections to be fitted together. This is described in more detail with respect to FIG. 5. Alternatively the flange 214, 216 may be fixed to an end plate 212 if the hollow lobe section is to be located at an axial end of the rotor.

The pumping chamber 306 is similar in construction to pumping chamber 308, except that the axial length of the chamber 306 is shorter and therefore only two hollow lobe sections are required to form each lobe. Similarly, pumping chambers 304, 302 are similar in construction to pumping chambers 308, 306, except that their axial lengths are shorter and therefore only one hollow lobe section, with two end plates 212, is required to form each lobe.

The end walls 104 which are located between the pumping chambers separate the pumping chambers from one another and are adapted to allow fluid to flow from the outlet of an upstream pumping chamber to the inlet of the adjacent downstream pumping chamber. The end walls 104 which are located at either axial end of the pumping stack separate the pumping stack from other components of the pump, such as gears and motor, and are adapted to allow fluid to flow into the inlet of the first (the most upstream) pumping chamber 308 and from the outlet of the last (the most downstream) pumping chamber 302.

In operation, each of the pumping chambers acts to pump fluid from its inlet to its outlet. The outlet of one pumping chamber is in fluid communication, via end wall 104, with the inlet of the adjacent downstream pumping chamber so that the compression achieved by the pump is cumulative.

Four pumping chambers are shown in FIG. 9, but more or fewer pumping chambers may be utilised depending on requirements. The pumping chambers shown in FIG. 9 have the same diameter, but, if desired, the pumping chambers may have different diameters from each other. Furthermore, each pumping chamber itself may not be of a constant diameter, but may be tapered.

All of the above examples show the end faces 212 being formed separately from the hollow lobe sections and being joined to them to create the sealed, hollow lobe. Alternatively, one of the end faces 212 may be formed integrally with the hollow lobe sections. Ideally the axial length of the hollow lobe sections should be chosen to optimise the manufacturing process, such that the hollow lobe sections, including their flanges and ribs, can be easily machined and fitted together. Furthermore, the axial length of the hollow lobe sections is ideally not too long or else access to the bolts which join the hollow lobe sections to the rotor shaft may be restricted.

Figure 10:
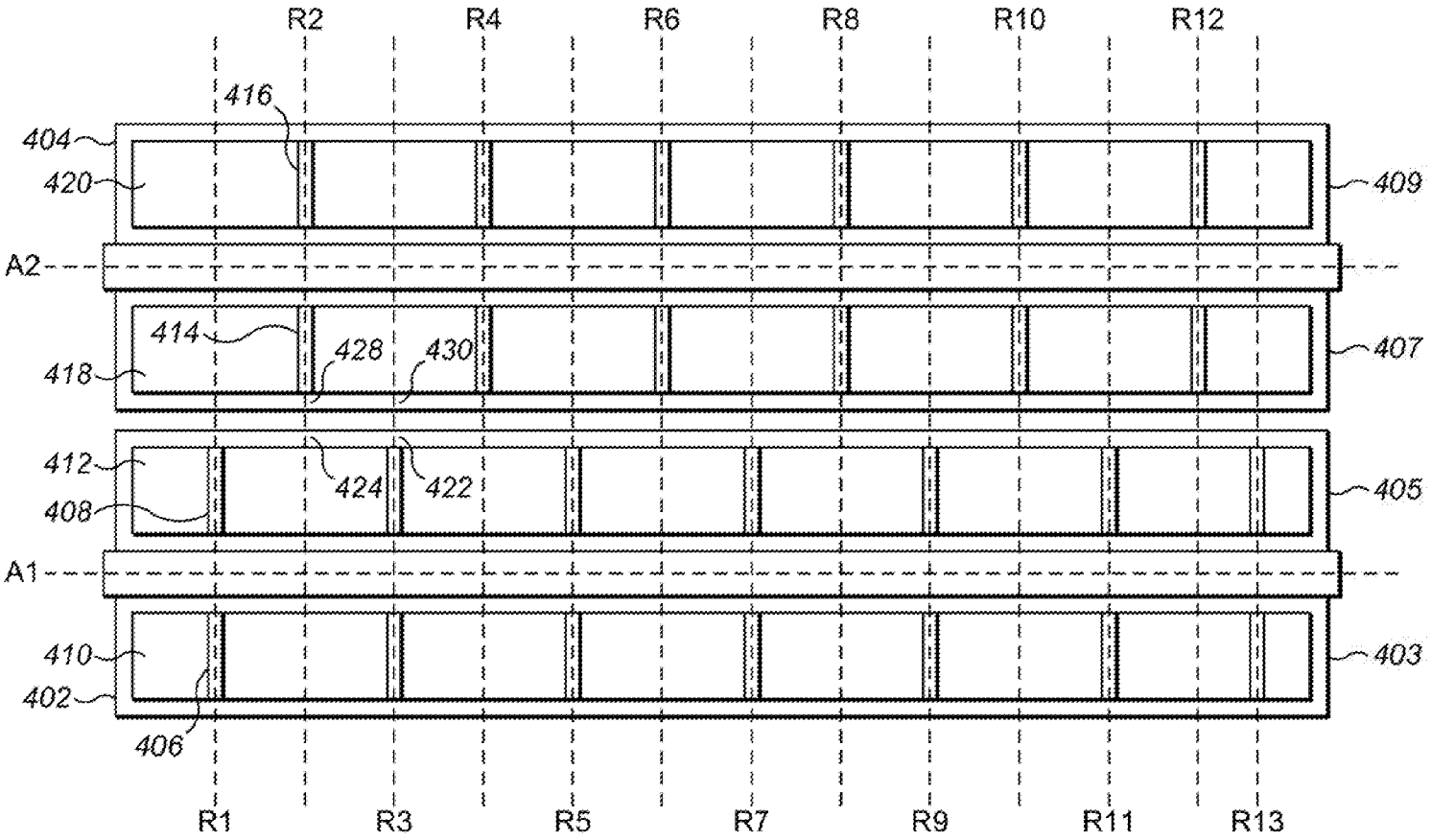
FIG. 10 shows a modified arrangement of the strengthening ribs in the lobe cavities of the rotors.

FIG. 10 shows a modified arrangement of strengthening ribs in respective rotors 402, 404 for a single stage pump. The arrangement is equally applicable to multi-stage pumps. For the purposes of this explanation the two rotors are shown spaced apart whereas in practice the lobes would overlap as described in more detail above.

Rotor 402 comprises lobes 403, 405 and rotor 404 comprises lobes 407, 409. The strengthening ribs 406, 408 of rotor 402 are located in respective lobe cavities 410, 412 and extend in radial planes R1, R3, R5, R7, R9, R11, and R13 relative to the axis A1. The strengthening ribs 414, 416 of rotor 404 are located in respective lobe cavities 418, 420 and extend in radial planes R2, R4, R6, R8, R10, and R12 relative to the axis A2. The radial planes R1, R3, R5, R7, R9, R11, and R13 of rotor 402 are misaligned with the radial planes R2, R4, R6, R8, R10, and R12 of rotor 404. It will be appreciated that the portions of the lobes which are in line with their supporting strengthening ribs are stronger than the portions of the lobes which are between the strengthening ribs in the axial direction. For example, with reference to the drawing, a portion 422 of lobe 405 which is generally in line with radial plane R3 is stronger than a portion 424 which is in between radial planes R1 and R3. Likewise, a portion 428 of lobe 407 which is generally in line with radial plane R2 is stronger than a portion 430 which is in between radial planes R2 and R4. The stronger portion 422 of lobe 405 is aligned with the deformable portion 430 of lobe 407, and the stronger portion 428 of lobe 407 is aligned with the deformable portion 424 of lobe 405. Accordingly, in the event of a high speed collision between rotors, the deformable portions of one lobe are deformed by the strong portions of another lobe thereby absorbing the high stored energy of the rotors. In this way, the less resilient portions can be deformed and act as crumple zones to reduce the possibility of lobe fragments breaking through the pump casing causing injury or damage.

As shown in FIG. 10, the strengthening ribs of rotor 402 are aligned and the strengthening ribs of rotor 404 are aligned, but the strengthening ribs of one rotor are misaligned with the strengthening ribs of the other rotor. The strengthening ribs of the lobes of one rotor may be aligned since they have a generally fixed relative relationship and will not clash. However, it will be appreciated that alignment of the strengthening ribs of the lobes of a single rotor is not a requirement to create crumple zones for absorbing the stored energy of rotors, as described above.

It can be seen that the present invention provides rotors having a high strength to weight ratio. In the drawings, the pumping chambers house two rotors which have intermeshing lobes, but the invention is equally applicable to other configurations, such as rotors having three or more lobes.

The invention claimed is:

1. A vacuum pump rotor for use in a vacuum pump having a roots pumping mechanism, the rotor comprising:

a shaft; and at least two hollow lobes, each respective hollow lobe comprising:

a respective outer wall which defines a lobe profile, and a respective hollow cavity generally inward of the respective outer wall, wherein:

each respective hollow lobe comprises at least two different means comprising at least one bolt and at least one dovetail for fixing the respective hollow lobe to the shaft, the shaft defines at least a portion of an outer surface of the rotor and respective bolt-holes for receiving respective bolts, and the at least two hollow lobes and the shaft are shaped so that the outer surface of the rotor includes a generally continuous profile between the at least two hollow lobes and the shaft.

2. The vacuum pump rotor of claim 1, wherein each respective outer wall comprises a varying wall thickness.

3. The vacuum pump rotor of claim 1, wherein the respective outer wall has a varying thickness that is thicker at a radially inner portion than at a lobe tip.

4. The vacuum pump rotor of claim 1, wherein a ratio of wall thickness to radius at a lobe tip is less than 1:20.

5. The vacuum pump rotor of claim 1, wherein each respective outer wall defines a thickness such that the respective hollow lobe deforms under centrifugal loading when the rotor is rotated in use and the deformation is greater than manufacturing tolerances.

6. The vacuum pump rotor of claim 1, wherein respective hollow lobe comprises a respective plurality of hollow lobe sections joined in axial succession along the rotor which together form the respective hollow lobe.

7. A vacuum pump comprising a rotor, the rotor comprising:

a shaft; and at least two hollow lobes, each respective hollow lobe comprising:

a respective outer wall which defines a lobe profile, and a respective hollow cavity generally inward of the respective outer wall, wherein:

each respective hollow lobe comprises at least two different means comprising at least one bolt and at least one dovetail for fixing the respective hollow lobe to the shaft, the shaft defines at least a portion of an outer surface of the rotor and respective bolt-holes for receiving respective bolts, and the at least two hollow lobes and the shaft are shaped so that the outer surface of the rotor includes a generally continuous profile between the at least two hollow lobes and the shaft.

8. The vacuum pump of claim 7, wherein each respective outer wall comprises a varying wall thickness.

9. The vacuum pump of claim 7, wherein the respective outer wall has a varying thickness that is thicker at a radially inner portion than at a lobe tip.

10. The vacuum pump of claim 7, wherein a ratio of wall thickness to radius at a lobe tip is less than 1:20.

11. The vacuum pump of claim 7, wherein each respective outer wall defines a thickness such that the respective hollow lobe deforms under centrifugal loading when the rotor is rotated in use and the deformation is greater than manufacturing tolerances.

12. The vacuum pump of claim 7, wherein respective hollow lobe comprises a respective plurality of hollow lobe sections joined in axial succession along the rotor which together form the respective hollow lobe.

13. A method of making a rotor for a vacuum pump, the method comprising:

forming at least two hollow lobes, wherein each respective hollow lobe comprises a respective outer wall which defines a lobe profile, wherein each respective outer wall defines a respective hollow cavity, wherein each respective hollow lobe comprises at least two different means comprising at least one bolt and at least one dovetail for fixing the respective hollow lobe to a rotor shaft; and attaching each respective hollow lobe of the at least two hollow lobes to a respective side of the rotor shaft using the at least two different means for fixing the respective hollow lobe to the rotor shaft, wherein the shaft defines at least a portion of an outer surface of the rotor, and wherein the at least two hollow lobes and the rotor shaft are shaped so that the outer surface of the rotor includes a generally continuous profile between the at least two hollow lobes and the rotor shaft, wherein attaching each respective hollow lobe of the at least two hollow lobes to the respective side of the rotor shaft comprises fitting the respective dovetail into a respective complementary shaped groove in the rotor shaft such that a radial movement of each respective hollow lobe with respect to the rotor shaft is reduced and fixing the respective bolt into a respective bolt-hole in the rotor shaft.

14. The method of claim 13, wherein each respective hollow lobe comprises at least two hollow lobe sections, wherein each respective hollow lobe section comprises at least one of the at least two different means for fixing the respective hollow lobe to the rotor shaft; and wherein attaching the at least two hollow lobes to respective sides of the rotor shaft comprises attaching each respective hollow lobe section to the rotor shaft.

15. The method of claim 14, wherein one of the at least two different means for fixing each respective hollow lobe section to the rotor shaft comprises the respective dovetail, wherein attaching the respective hollow lobe section to the respective side of the rotor shaft comprises fitting the respective dovetail into a respective complementary shaped groove in the rotor shaft.

16. A method of making a rotor for a vacuum pump, the method comprising:

forming at least two hollow lobes, wherein each respective hollow lobe comprises a respective outer wall which defines a lobe profile, wherein each respective outer wall defines a respective hollow cavity, and wherein each respective hollow lobe comprises at least two different means for fixing the respective hollow lobe to the rotor shaft, wherein the at least two different means for fixing the respective hollow lobe to the rotor shaft comprise at least one bolt and at least one dovetail for fixing the respective hollow lobe to a rotor shaft; and attaching the at least two hollow lobes to respective sides of the rotor shaft using the at least two different means for fixing the respective hollow lobe to the rotor shaft, wherein the shaft defines at least a portion of an outer surface of the rotor, and wherein the at least two hollow lobes and the shaft are shaped so that the outer surface of the rotor includes a generally continuous profile between the at least two hollow lobes and the shaft.

* * * * *